US007059867B1

(12) United States Patent
McDermott et al.

(10) Patent No.: US 7,059,867 B1
(45) Date of Patent: Jun. 13, 2006

(54) HIGH DENSITY MULTI-LEAD SURFACE MOUNT INTERCONNECT AND DEVICES INCLUDING SAME

(75) Inventors: Bernard C. McDermott, Co. Cork (IE); Dermot O. Dobbyn, Co. Cork (IE)

(73) Assignee: Artesyn Technologies, Inc., Boca Raton, FL (US)

( * ) Notice: Subject to any disclaimer, the term of this patent is extended or adjusted under 35 U.S.C. 154(b) by 0 days.

(21) Appl. No.: 11/094,582

(22) Filed: Mar. 30, 2005

(51) Int. Cl.
*H01R 12/00* (2006.01)

(52) U.S. Cl. ..... 439/66; 439/74

(58) Field of Classification Search ..... 439/66, 439/74

See application file for complete search history.

(56) References Cited

U.S. PATENT DOCUMENTS 4,203,203 A * 5/1980 Gilissen et al. ..... 29/846
5,273,439 A * 12/1993 Szerlip et al. ..... 439/66
5,599,193 A * 2/1997 Crotzer ..... 439/66
5,915,975 A 6/1999 McGrath
6,056,557 A * 5/2000 Crotzer et al. ..... 439/66
6,264,476 B1 * 7/2001 Li et al. ..... 439/66
6,270,362 B1 8/2001 Guran et al.
6,280,207 B1 * 8/2001 Sakata et al. ..... 439/91
6,774,310 B1 8/2004 Dishongh et al.
6,792,679 B1 * 9/2004 Tai et al. ..... 29/877
6,860,003 B1 3/2005 Roy
6,884,116 B1 4/2005 Suzuki et al.

* cited by examiner

*Primary Examiner*—Tho D. Ta
(74) *Attorney, Agent, or Firm*—Kirkpatrick & Lockhart Nicholson Graham LLP

(57) ABSTRACT

A multi-lead surface mount interconnect. The interconnect includes a carrier, a first lead connected to the carrier, and a second lead connected to the carrier. The carrier defines a first receiving area and a second receiving area. The first lead includes a first planar surface for connection to a first printed circuit board and a second planar surface for connection to a second printed circuit board. The first planar surface is opposite the second planar surface. The second lead includes a third planar surface for connection to the first printed circuit board and a fourth planar surface for connection to the second printed circuit board. The third planar surface is opposite the fourth planar surface. The first planar surface is coplanar with the third planar surface. The second planar surface is coplanar with the fourth planar surface.

27 Claims, 14 Drawing Sheets

HIGH DENSITY MULTI-LEAD SURFACE MOUNT INTERCONNECT AND DEVICES INCLUDING SAME

BACKGROUND OF INVENTION

This application is related, generally and in various embodiments, to a high density multi-lead surface mount interconnect. For applications requiring a board-to-board power connection, it is well known in the art to use a surface mountable copper block to connect one printed circuit board to another printed circuit board. Although such copper blocks can safely deliver a high current from one board to the other, they can also be relatively expensive to fabricate and can consume a relatively large area of the respective printed circuit boards.

It is also well known in the art to use a multitude of such copper blocks for applications requiring a multitude of board-to-board power connections. However, because each copper block must be individually placed onto one of the respective printed circuit boards, the multiple connection process can be a relatively expensive process to complete.

In addition, many applications also require board-to-board connections other than power connections. For example, many applications also require signal type connections that do not require the high current carrying capability of the copper block interconnect. The use of copper block interconnects having high current carrying capability for such connections consumes more printed circuit board area than necessary, and results in an interconnect that is more expensive than necessary.

SUMMARY

In one general respect, this application discloses a high density multi-lead surface mount interconnect. According to various embodiments, the interconnect includes a carrier, a first lead connected to the carrier, and a second lead connected to the carrier. The carrier defines a first receiving area and a second receiving area. The first lead includes a first planar surface for connection to a first printed circuit board and a second planar surface for connection to a second printed circuit board. The first planar surface is opposite the second planar surface. The second lead includes a third planar surface for connection to the first printed circuit board and a fourth planar surface for connection to the second printed circuit board. The third planar surface is opposite the fourth planar surface. The first planar surface is coplanar with the third planar surface. The second planar surface is coplanar with the fourth planar surface.

In another general respect, this application discloses devices that include a high density multi-lead surface mount interconnect. According to various embodiments, the device includes a printed circuit board and a high density multi-lead surface mount interconnect connected to the printed circuit board. The interconnect includes a carrier, a first lead connected to the carrier, and a second lead connected to the carrier. The carrier defines a first receiving area and a second receiving area. The first lead includes a first planar surface and a second planar surface opposite the first planar surface. The second lead includes a third planar surface and a fourth planar surface opposite the third planar surface. The first planar surface and the third planar surface are connected to the printed circuit board. The second planar surface is coplanar with the fourth planar surface. According to various embodiments, the second planar surface and the fourth planar surface are connected to another second printed circuit board.

In another general respect, this application discloses a method of forming a device. According to various embodiments, the method includes forming a plurality of leads from a strip of stock material, connecting the plurality of leads to a carrier having a plurality of receiving areas such that a resulting width of each of the leads is equivalent to a thickness of the strip, and connecting the plurality of leads to a printed circuit board.

DETAILED DESCRIPTION OF THE INVENTION

Figure 1:
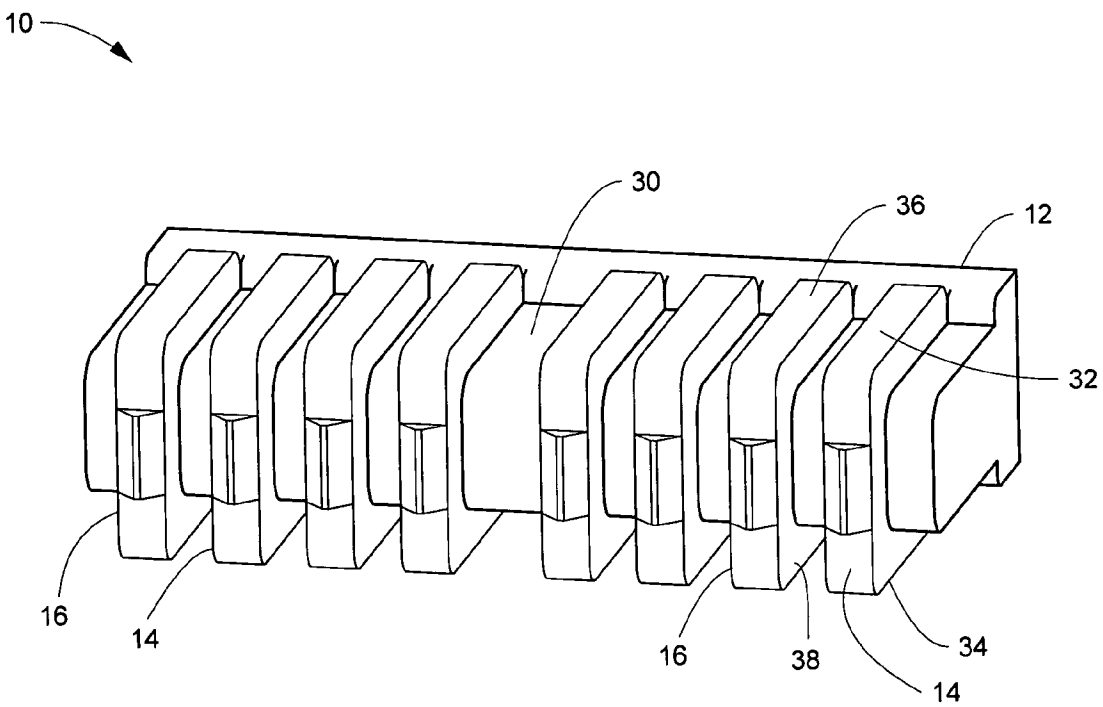
FIGS. 1–3 illustrate various embodiments of a high density multi-lead surface mount interconnect.
Figure 2:
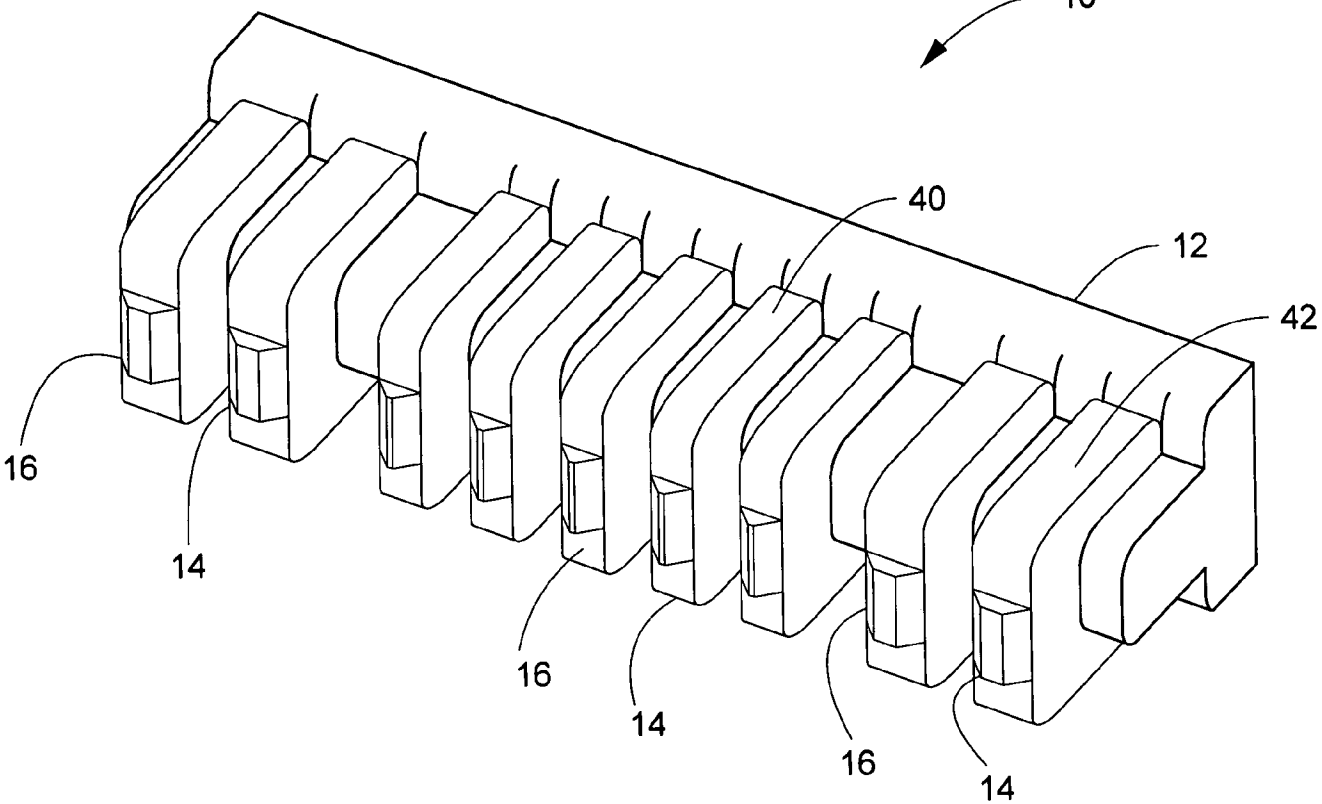
Figure 3:
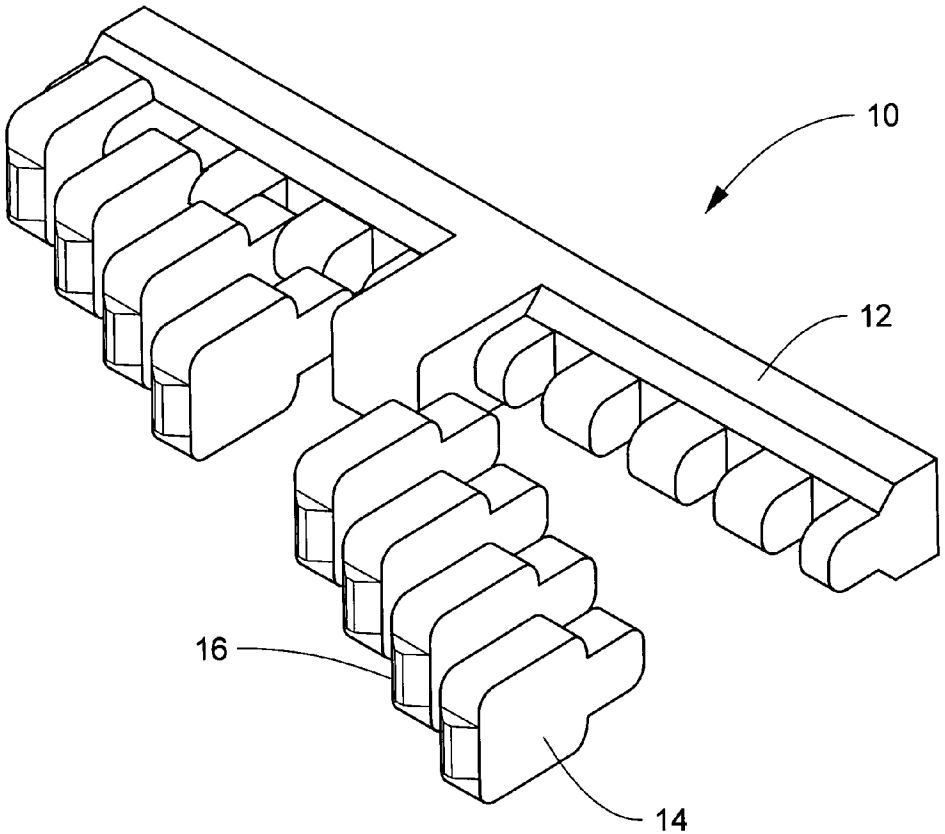

FIGS. 1–3 illustrate various embodiments of a high density multi-lead surface mount interconnect 10. The interconnect 10 may be used to provide an electrical and mechanical connection between two adjacent substrates, printed circuit boards, printed wiring boards, or any combination thereof.

Figure 4:
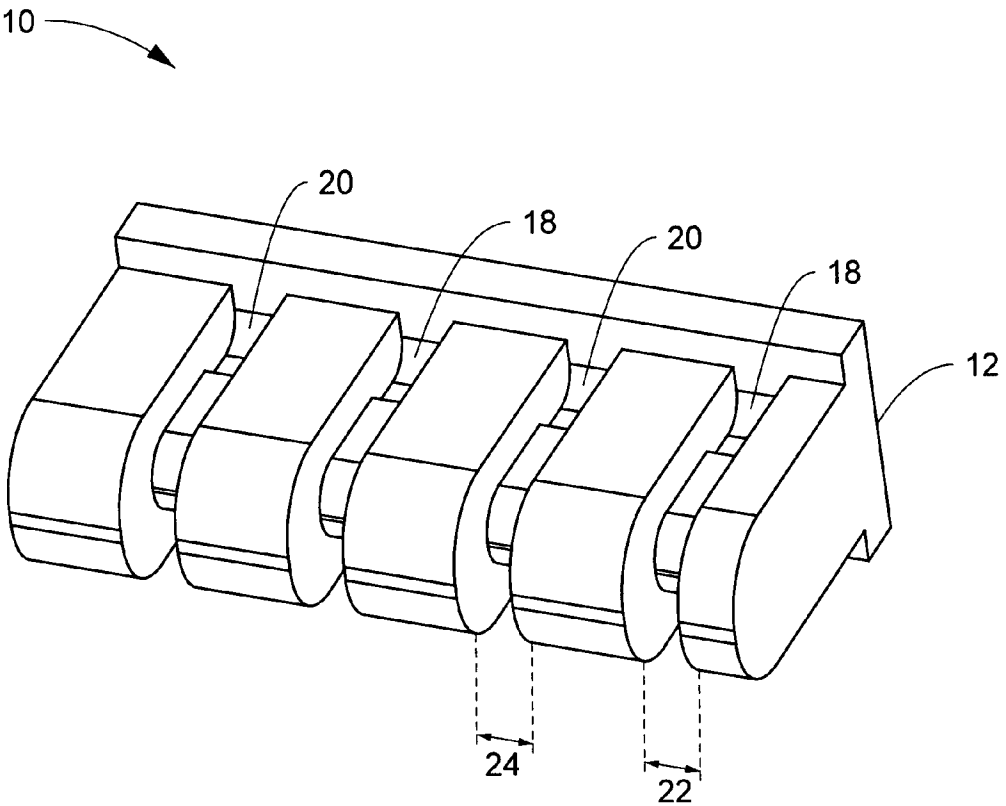
FIG. 4 illustrates various embodiments of a carrier of the interconnect of FIG. 1.
Figure 5:
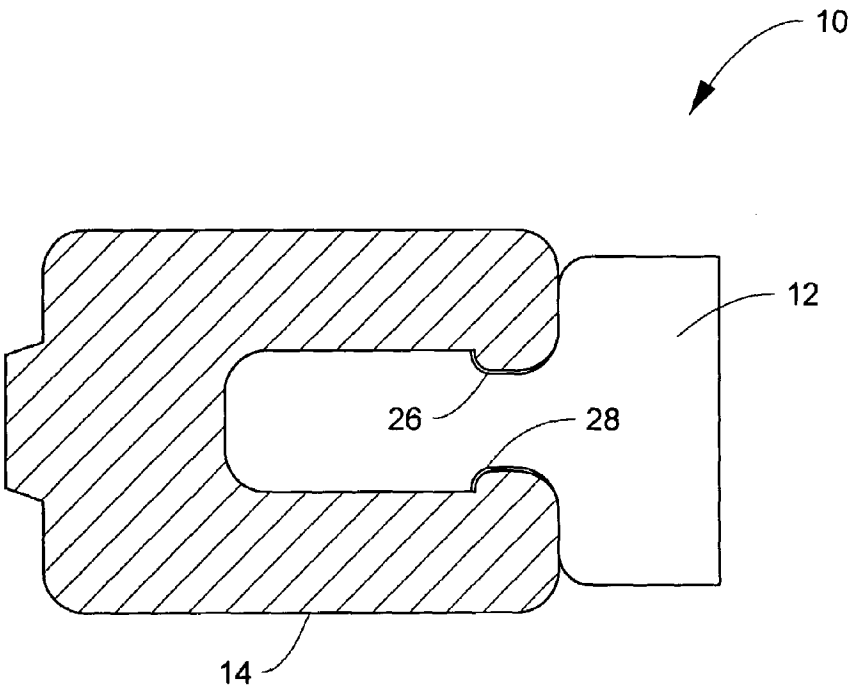
FIG. 5 illustrates various embodiments of a cross-section of the interconnect of FIG. 1.
Figure 6:
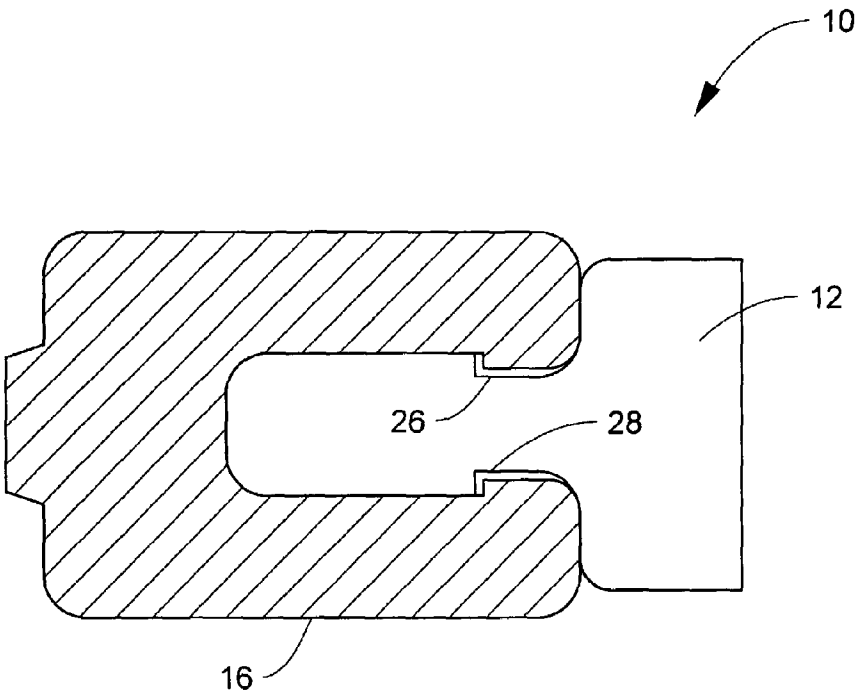
FIG. 6 illustrates various embodiments of a cross-section of the interconnect of FIG. 1.

The interconnect 10 includes a carrier 12, a first lead 14, and a second lead 16. As shown in FIG. 4, the carrier 10 defines a first receiving area 18 and a second receiving area 20. The first receiving area 18 has a first width 22 associated therewith and the second receiving area 20 has a second width 24 associated therewith. According to various embodiments, the first receiving area 18 may be congruent with the second receiving area 20. According to other embodiments, the first width 22 associated with the first receiving area 18 may be greater than the second width 24 associated with the second receiving area 20. As shown in FIG. 4, the carrier 10 may further define a plurality of first and second receiving areas 18, 20. According to various embodiments, the carrier 12 may define a first retention member 26 and a second retention member 28 at each of the first and second receiving areas 18, 20. The first and second retention members 26, 28 may be embodied as, for example, a hook or a notch as shown in FIGS. 5 and 6. The carrier 12 may also include at least one planar surface 30 that is suitable for cooperation with a pick-and-place machine. According to various embodiments, the carrier 12 may be fabricated from any suitable non-conductive material such as, for example, a plastic.

The first lead 14 is connected to the carrier 12 and includes a first planar surface 32 and a second planar surface 34. The second planar surface 34 is opposite the first planar surface 32. The first planar surface 32 is for connection to a first printed circuit board (not shown) and the second planar surface 34 is for connection to a second printed circuit board (not shown). The second lead 16 is connected to the carrier 12 and includes a third planar surface 36 and a fourth planar surface 38. The fourth planar surface 38 is opposite the third planar surface 36. The third planar surface 36 is for connection to a first printed circuit board (not shown) and the fourth planar surface 38 is for connection to a second printed circuit board (not shown). The first planar surface 32 may be coplanar with the third planar surface 36 and the second planar surface 34 may be coplanar with the fourth planar surface 38. As shown in FIGS. 1–3, the interconnect 10 may include a plurality of first and second leads 14, 16.

Although the first and second leads 14, 16 may be of any suitable shape, according to various embodiments, the first leads 14 may be generally U-shaped as shown in FIGS. 1 and 2 or generally T-shaped as shown in FIG. 3 and the second leads 16 may be generally U-shaped as shown in FIGS. 1 and 2 or generally T-shaped as shown in FIG. 3. As shown in FIG. 2, the interconnect 10 may include a plurality of power pins and a plurality of signal pins. According to various embodiments, the first leads 14 may serve as signal pins or power pins, and the second leads 16 may serve as signal pins or power pins. Thus, the first lead 14 may have a first thickness 40 associated therewith when it is to serve as a signal pin and a second thickness 42 associated therewith when it is to serve as a power pin. Similarly, the second lead 16 may be associated with the first thickness 40 when it is to serve as a signal pin and with the second thickness 42 when it is to serve as a power pin. For embodiments where the first lead 14 is to serve as a signal pin and the second lead 16 is to serve as a power pin, the first thickness 40 associated with the first lead 14 may be less than the second thickness 42 associated with the second lead 16. For embodiments where the first lead 14 is to serve as a power pin and the second lead 16 is to serve as a signal pin, the second thickness 42 associated with the first lead 14 may be greater than the first thickness 40 associated with the second lead 16. For embodiments where the first and second leads 14, 16 are both to serve as signal pins, the first lead 14 may be congruent with the second lead 16. The first and second leads 14, 16 may also be congruent when the first and second leads 14, 16 are both to serve as power pins.

According to various embodiments, the first lead 14 may be connected to the carrier 12 by interference fit at the first receiving area 18 and the second lead 16 may be connected to the carrier 12 by interference fit at the second receiving area 20. According to other embodiments, the first lead 14 may be connected to the carrier 12 via the first and second retention members 26, 28 at the first receiving area 18, and the second lead 16 may be connected to the carrier 12 via the first and second retention members 26, 28 at the second receiving area 20. According to various embodiments, the first and second leads 14, 16 may be fabricated from a conductive material such as, for example, copper, a copper alloy, phosphor bronze, alloy 194, etc.

As stated hereinabove, the interconnect 10 may include a plurality of first and second leads 14, 16. Each pair of adjacent leads defines a distance therebetween. According to various embodiments, the distance between a first pair of adjacent leads may be equivalent to the distance between a second pair of adjacent leads as shown in FIGS. 1–3. For example, when the first pair of adjacent leads comprise leads that are both to serve signal pins and the second pair of adjacent leads comprise leads that are both to serve as signal pins, the distance between the first pair of adjacent leads may be equivalent to the distance between the second pair of adjacent leads. According to various embodiments, the distance between a first pair of adjacent leads may be greater than the distance between a second pair of adjacent leads as shown in FIG. 2. For example, when the first pair of adjacent leads comprise leads that are both to serve signal pins and the second pair of adjacent leads comprise leads that are both to serve as power pins, the distance between the first pair of adjacent leads may be greater than the distance between the second pair of adjacent leads.

According to various embodiments, the first lead 14 may be identical to the second lead 16, the first receiving area 18 may be identical to the second receiving area 20, and the first retention member 26 may be identical to the second retention member 28.

Figure 7:
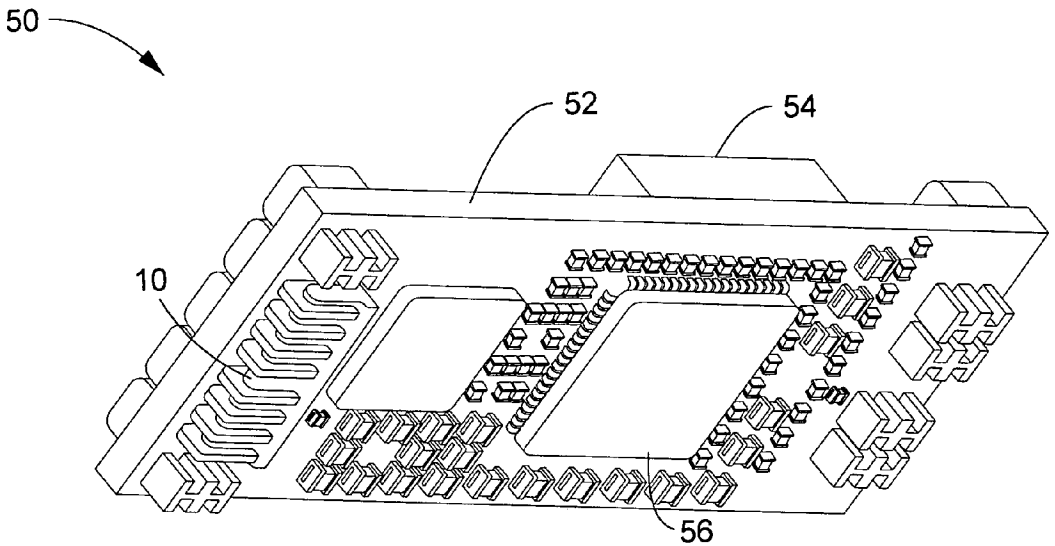
FIG. 7 illustrates various embodiments of a device that includes the interconnect of FIG. 1.

FIG. 7 illustrates various embodiments of a device 50 that includes the interconnect 10 of FIG. 1. The device 50 also includes a printed circuit board 52 connected to the interconnect 10 via the first and second leads 14, 16. According to various embodiments, the first planar surface 32 of the first lead 14 may be connected to the printed circuit board 52 and the third planar surface 36 of the second lead 16 may be connected to the printed circuit board 52. For such embodiments, the second planar surface 34 of the first lead 14 may be coplanar with the fourth planar surface 38 of the second lead 14, 16. According to various embodiments, the first planar surface 32 of the first lead 14 may be soldered to the printed circuit board 52 and the third planar surface 36 of the second lead 16 may be soldered to the printed circuit board 52.

As shown in FIG. 7, the device 50 may also include a power component 54 mounted to one surface of the printed circuit board 52 and a control component 56 mounted to another surface of the printed circuit board 52. According to various embodiments, the device 50 may be embodied as a DC—DC converter.

Figure 8:
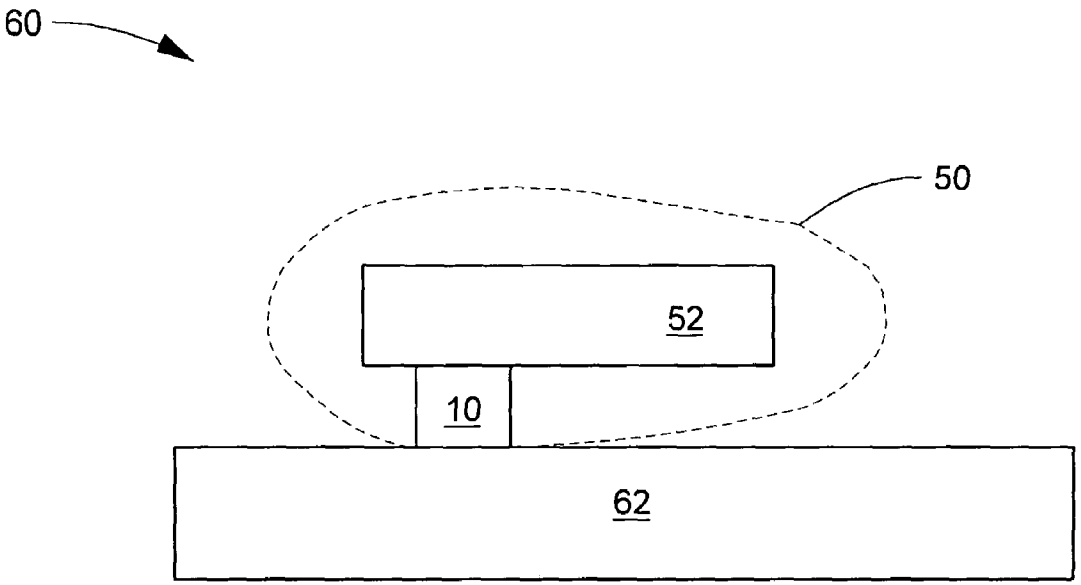
FIG. 8 illustrates various embodiments of a device that includes the interconnect of FIG. 1.

FIG. 8 illustrates a device 60 that includes the device 50 of FIG. 7. The device 60 may also include a second printed circuit board 62 connected to the interconnect 10. The second printed circuit board 62 may be, for example, an application board. According to various embodiments, the first planar surface 32 of the first lead 14 and the third planar surface 36 of the second lead 16 may be connected to the printed circuit board 52 of the device 50, and the second planar surface 34 of the first lead 14 and the fourth planar surface 38 of the second lead 16 may be connected to the second printed circuit board 62. According to various embodiments, the second planar surface 34 of the first lead 14 may be soldered to the second printed circuit board 62 and the fourth planar surface 38 of the second lead 16 may be soldered to the second printed circuit board 62. According to various embodiments, the device 60 may be embodied as a power supply.

Figure 9:
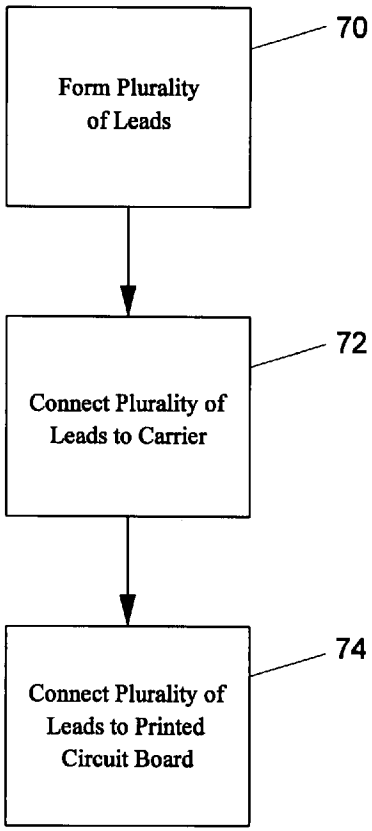
FIG. 9 illustrates various embodiments of a method of forming a device that includes the interconnect of FIG. 1.
Figure 10:
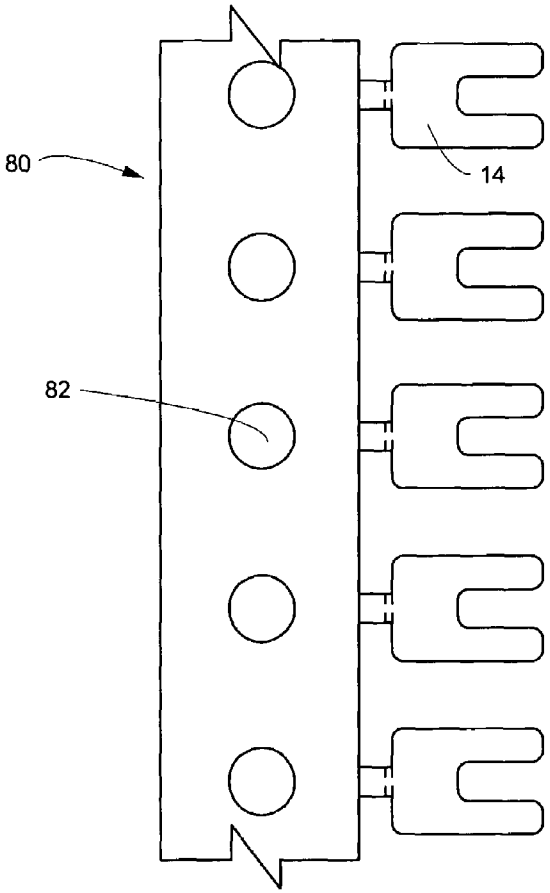
FIG. 10 illustrates various embodiments of a portion of a strip of stock material after leads have been formed therefrom.
Figure 11:
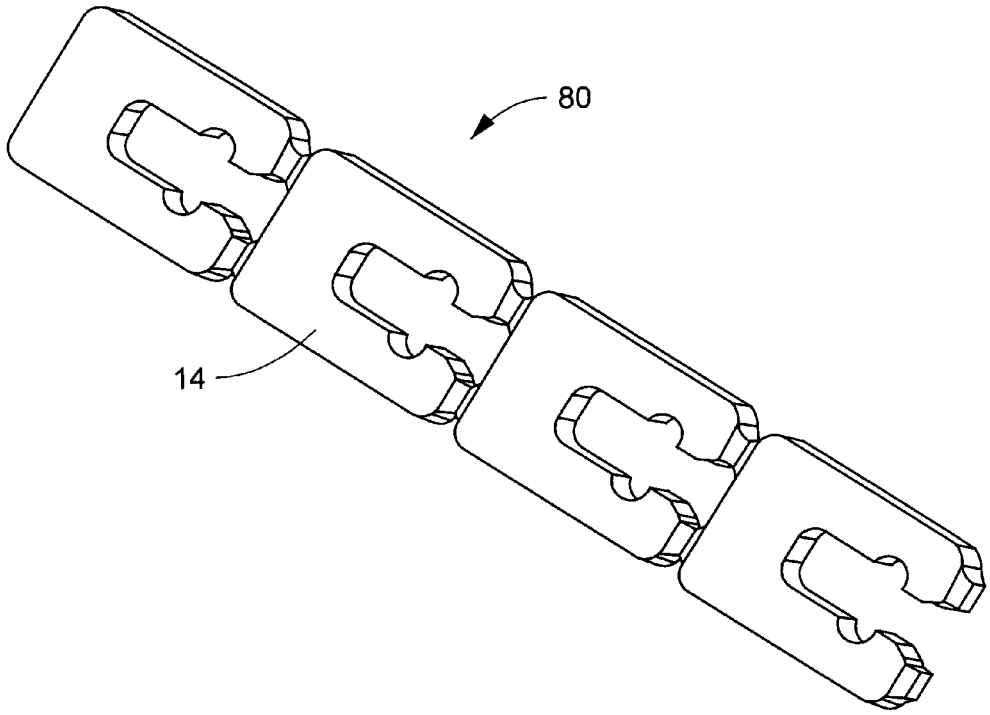
FIG. 11 illustrates various embodiments of a portion of a strip of stock material after leads have been formed therefrom.

FIG. 9 illustrates various embodiments of a method of forming the device 50 of FIG. 7. The process begins at block 70, where a plurality of leads 14 are formed by stamping a strip of stock material having a length, a width and a thickness associated therewith. Examples of various embodiments of a portion of the strip 80 after the leads 14 have been formed are illustrated in FIGS. 10 and 11. As shown in FIG. 10, according to various embodiments, the strip 80 may still include indexing holes 82 following the stamping process. As shown in FIG. 11, according to various embodiments, the strip 80 may no longer include indexing holes 82 following the stamping process.

From block 70, the process advances to block 72, where the leads 14 are connected to the carrier 12 thereby forming the interconnect 10. The leads 14 may be connected to the carrier 12, for example, by interference fit or by retention members 26. The leads 14 may be connected to the carrier 12 such that the respective first planar surfaces 32 of the leads 14 are coplanar and the respective second planar surfaces 34 of the leads 14 are coplanar. The leads 14 may also be connected to the carrier 12 in a manner such that the thickness of the strip 80 determines the resulting width of the leads 14. In other words, each lead 14 may be oriented with respect to the carrier 12 such that the thickness of the strip 80 of stock material used to form the leads 14 is equivalent to the resulting width of the leads 14.

Leads 14 of different resulting widths may be formed from strips 80 of different thicknesses. As the thickness of the strip 80 may determine the resulting width of the leads 14, the thickness of the strip 80 may also determine the pitch of the leads 14 of the interconnect 10. When the leads 14 are formed from a relatively thin strip of material (e.g., 0.25 mm), the interconnect 10 may be formed to include a high number of leads 14 in a relatively small area. For a given area, when the leads 14 are formed from a relatively thin strip of material instead of from a relatively thick strip of material, the interconnect 10 will include a higher number of leads 14 in the given area.

From block 72, the process advances to block 74, where the leads 14 are connected to the printed circuit board 52, thereby forming the device 50. To connect the leads 14 to the printed circuit board 52, a vacuum nozzle of a pick-and-place machine may be brought into contact with the planar surface 30 of the carrier 12 of the interconnect 10 to pick the interconnect 10. Once the interconnect 10 has been picked, the pick-and-place machine may then place the interconnect 10 at the desired position on the printed circuit board 52. Once the interconnect 10 is in the desired position, the leads 14 may be connected to the printed circuit board 52 by soldering the respective first planar surfaces 32 of the leads 14 to the printed circuit board 52.

In view of the foregoing, it will be appreciated that there is no need to further form the leads 14 after the stamping is completed at block 70 in order to create the coplanar surfaces defined by the respective first planar surfaces 32 of the leads 14.

According to various embodiments, the carrier 12 may be shortened to a predetermined length after the lead 14 is connected to the carrier 12. The shortening may be accomplished by cutting the carrier 12, and the shortened carrier 12 may include a predetermined number of leads required for a particular application.

Figure 12:
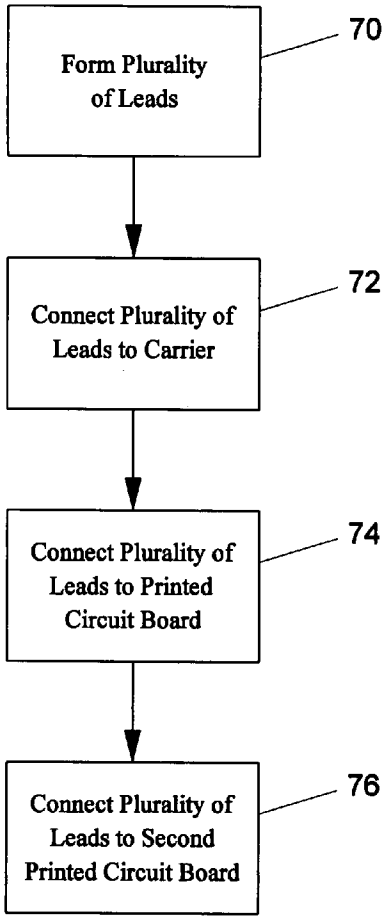
FIG. 12 illustrates various embodiments of a method of forming a device that includes the interconnect of FIG. 1.

FIG. 12 illustrates various embodiments of a method of forming the device 60 of FIG. 7. The process may be similar to the process described hereinabove with respect to FIG. 9, but further includes connecting the leads 14 to the second printed circuit board 62 at block 76, thereby forming the device 60. The leads 14 may be connected to the second printed circuit board 62 by soldering the respective second planar surfaces 34 of the leads 14 to the second printed circuit board 62. According to various embodiments, the distance between the respective first planar surfaces 32 and the respective second planar surfaces 34 may determine the stand-off height between the first printed circuit board 52 and the second printed circuit board 62.

Figure 13:
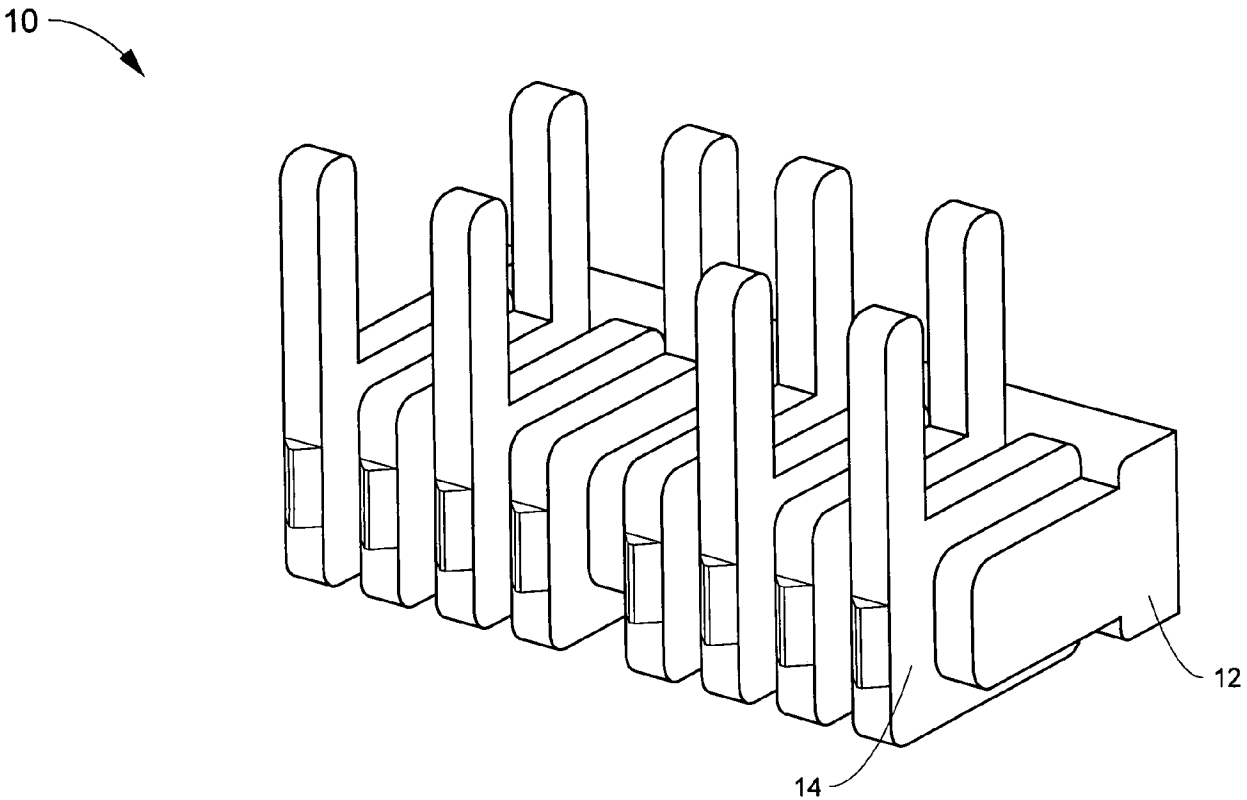
FIGS. 13–14 illustrate various embodiments of a high density multi-lead interconnect.
Figure 14:
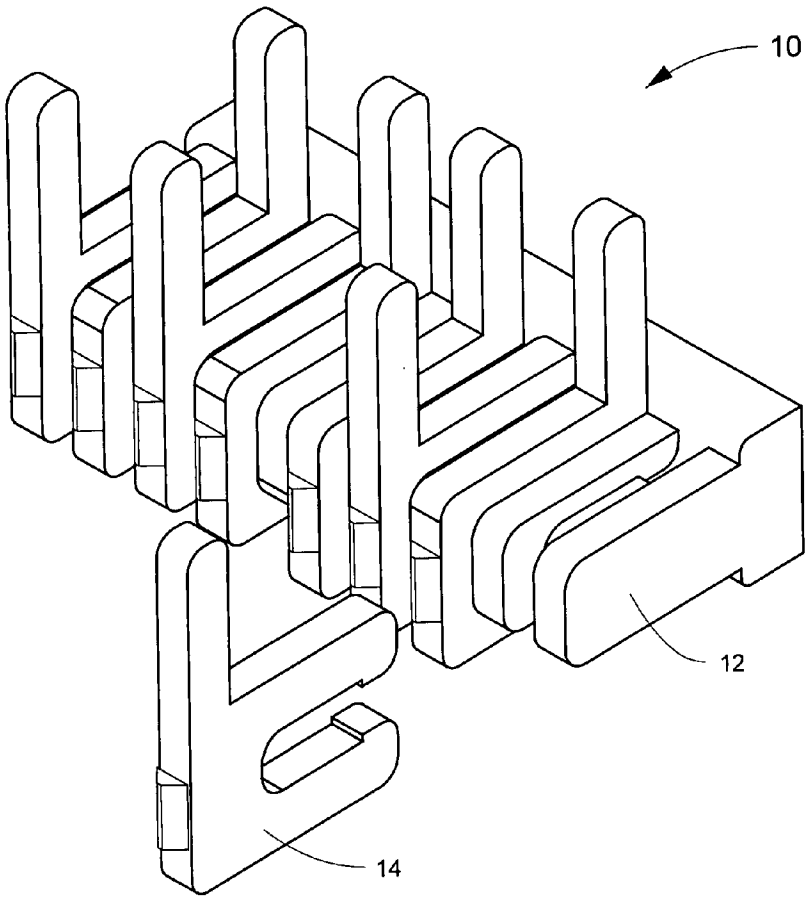

While several embodiments of the invention have been described, it should be apparent, however, that various modifications, alterations and adaptations to those embodiments may occur to persons skilled in the art with the attainment of some or all of the advantages of the present invention. For example, one surface of the first lead 14 may be surface mounted to the printed circuit board 52 and an opposite surface of the first lead 14 may be through hole mounted to the second printed circuit board 62 which may be oriented parallel to or perpendicular to the printed circuit board 52. FIGS. 13–14 illustrate various embodiments of a high density multi-lead interconnect 10 having leads 14 suitable for surface mounting to the printed circuit board 52 and through hole mounted to the second printed circuit board 62 when the second printed circuit board 62 is oriented parallel to the printed circuit board 52. It is therefore intended to cover all such modifications, alterations and adaptations without departing from the scope and spirit of the present invention as defined by the appended claims.

What is claimed is:

1. A high density multi-lead surface mount interconnect, comprising:

an elongated carrier, wherein the carrier defines a first receiving area and a second receiving area on an exterior surface of the carrier;

a first lead connected to the carrier at the first receiving, area wherein the first lead includes:

a first planar surface for connection to a first printed circuit board; and a second planar surface for connection to a second printed circuit board, wherein the second planar surface is opposite the first planar surface; and a second lead connected to the carrier at the second receiving area, wherein the second lead includes:

a third planar surface for connection to the first printed circuit board, wherein the third planar surface is coplanar with the first planar surface; and a fourth planar surface for connection to the second printed circuit board, wherein the fourth planar surface is opposite the third planar surface and coplanar with the second planar surface.

2. The interconnect of claim 1, wherein the carrier is fabricated from a nonconductive material.

3. The interconnect of claim 1, wherein the carrier includes at least one planar surface.

4. The interconnect of claim 1, wherein the first receiving area is congruent with the second receiving area.

5. The interconnect of claim 1, wherein:

the first receiving area has a first width associated therewith; and the second receiving area has a second width associated therewith, wherein the first width is greater than the second width.

6. The interconnect of claim 1, wherein the carrier further defines a plurality of first receiving areas and a plurality of second receiving areas.

7. The interconnect of claim 1, wherein at least one of the first and second leads is connected to the carrier by interference fit.

8. The interconnect of claim 1, wherein at least one of the first and second leads is connected to the carrier via a retention member defined by the carrier.

9. The interconnect of claim 1, wherein at least one of the first and second leads is generally u-shaped.

10. The interconnect of claim 1, wherein at least one of the first and second leads is generally T-shaped.

11. The interconnect of claim 1, wherein the first and second leads are congruent.

12. The interconnect of claim 1, further comprising:

a plurality of first leads connected to the carrier, wherein each of the first leads includes a first planar surface and a second planar surface opposite the first planar surface; and a plurality of second leads connected to the carrier, wherein each of the second leads includes a third planar surface coplanar with the first planar surfaces and a fourth planar surface that is opposite the third planar surface and coplanar with the second planar surfaces.

13. The interconnect of claim 1, wherein:

the first lead has a first thickness associated therewith; and the second lead has a second thickness associated therewith, wherein the first thickness is greater than the second thickness.

14. The interconnect of claim 13, wherein:

a first pair of adjacent leads define a first distance therebetween; and a second pair of adjacent leads define a second distance therebetween, wherein the first distance is equivalent to the second distance.

15. The interconnect of claim 13, wherein:

a first pair of adjacent leads define a first distance therebetween; and a second pair of adjacent leads define a second distance therebetween, wherein the first distance is greater than the second distance.

16. A device, comprising:

a printed circuit board; and a high density multi-lead surface mount interconnect connected to the printed circuit board, wherein the interconnect includes:

an elongated carrier, wherein the carrier defines a first receiving area and a second receiving area on an exterior surface of the carrier;

a first lead connected to the carrier at the first receiving area, wherein the first lead includes:

a first planar surface connected to the printed circuit board; and a second planar surface for connection to another printed circuit board, wherein the second planar surface is opposite the first planar surface; and a second lead connected to the carrier at the second receiving area, wherein the second lead includes:

a third planar surface connected to the printed circuit board; and a fourth planar surface for connection to the another printed circuit board, wherein the fourth planar surface is opposite the third planar surface and coplanar with the second planar surface.

17. The device of claim 16, wherein the interconnect further includes:

a plurality of first leads connected to the carrier, wherein each of the first leads includes a first planar surface soldered to the printed circuit board and a second planar surface opposite the first planar surface; and a plurality of second leads connected to the carrier, wherein each of the second leads includes a third planar surface soldered to the printed circuit board and a fourth planar surface that is opposite the third planar surface and coplanar with the second planar surfaces.

18. The device of claim 16, wherein the device is a converter.

19. The device of claim 16, wherein at least one of the first and second leads is soldered to the printed circuit board.

20. The device of claim 19, wherein at least one of the first and third planar surfaces is soldered to the printed circuit board.

21. The device of claim 19, further comprising a power component mounted to the printed circuit board.

22. The device of claim 21, further comprising a control component mounted to the printed circuit board.

23. A device, comprising:

a first printed circuit board;

a second printed circuit board; and a high density multi-lead surface mount interconnect connected to the first printed circuit board and the second printed circuit board, wherein the interconnect includes:

an elongated carrier, wherein the carrier defines a first receiving area and a second receiving area on an exterior surface of the carrier;

a first lead connected to the carrier at the first receiving area, wherein the first lead includes a first planar surface connected to the first printed circuit board and a second planar surface connected to the second printed circuit board; and a second lead connected to the carrier at the second receiving areas wherein the second lead includes a third planar surface connected to the first printed circuit board and a fourth planar surface connected to the second printed circuit board.

24. The device of claim 23, wherein at least one of the first and second leads is soldered to the first and second printed circuit boards.

25. The device of claim 23, wherein the interconnect further includes:

a plurality of first leads connected to the carrier, wherein each of the first leads includes a first planar surface soldered to the first printed circuit board and a second planar surface soldered to the second printed circuit board; and a plurality of second leads connected to the carrier, wherein each of the second leads includes a third planar surface soldered to the first printed circuit board and a fourth planar surface soldered to the second printed circuit board.

26. The device of claim 23, wherein the first printed circuit board comprises a portion of a converter.

27. The device of claim 23, wherein the device is a power supply.

* * * * *

UNITED STATES PATENT AND TRADEMARK OFFICE

CERTIFICATE OF CORRECTION

PATENT NO. : 7,059,867 B1
APPLICATION NO. : 11/094582
DATED : June 13, 2006
INVENTOR(S) : B. McDermott et al.

It is certified that error appears in the above-identified patent and that said Letters Patent is hereby corrected as shown below:

COLUMN 4

Line 5, delete "that are both to serve signal pins" and substitute therefor --serve as signal pins--.

COLUMN 4

Line 13, delete "that are both to serve signal pins" and substitute therefor --serve as signal pins--.

COLUMN 6

Line 28, delete "at the first receiving, area" and substitute therefor --at the first receiving area,--.

COLUMN 8

Line 35, Claim 23, delete "receiving areas" and substitute therefor --receiving area--.

Signed and Sealed this

Nineteenth Day of December, 2006

JON W. DUDAS
*Director of the United States Patent and Trademark Office*